US006290808B1

(12) United States Patent
McKee et al.

(10) Patent No.: US 6,290,808 B1
(45) Date of Patent: Sep. 18, 2001

(54) CHEMICAL MECHANICAL POLISHING MACHINE WITH ULTRASONIC VIBRATION AND METHOD

(75) Inventors: Jeffrey A. McKee, Grapevine; Ming J. Hwang, Dallas; Chih-Chen Cho, Richardson, all of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/287,378

(22) Filed: Apr. 7, 1999

Related U.S. Application Data

(60) Provisional application No. 60/081,111, filed on Apr. 8, 1998.

(51) Int. Cl.[7] ..... C23F 1/02
(52) U.S. Cl. ..... 156/345
(58) Field of Search ..... 156/345; 438/690, 438/691, 692, 693, 746; 451/64, 83

(56) References Cited

U.S. PATENT DOCUMENTS 4,879,258 11/1989 Fisher ..... 437/225
5,522,965 * 6/1996 Chisholm et al. ..... 438/693
5,531,861 * 7/1996 Yu et al. ..... 438/693
5,688,364 * 11/1997 Sato ..... 438/693
5,895,550 * 4/1999 Andreas ..... 156/345
5,897,425 * 4/1999 Fisher, Jr. et al. ..... 451/41
5,961,372 * 10/1999 Shendon ..... 451/41
6,000,997 * 12/1999 Kao et al. ..... 451/7

* cited by examiner

*Primary Examiner*—Benjamin L. Utech
*Assistant Examiner*—Binh X. Tran
(74) *Attorney, Agent, or Firm*—W. James Brady, III; Frederick J. Telecky, Jr.

(57) ABSTRACT

A chemical mechanical polishing machine with ultrasonic vibration is disclosed. The chemical mechanical polishing machine (10) includes a movable abrasive surface (14). A wafer holder (12) holds a wafer (18) in contact with the abrasive surface (14), and a vibration generator (16) vibrates the wafer (18) during polishing. The ultrasonic vibration agitates the slurry and provides an additional degree of motion between the wafer and the abrasive surface, thereby increasing the speed and uniformity of the polishing.

2 Claims, 2 Drawing Sheets

CHEMICAL MECHANICAL POLISHING MACHINE WITH ULTRASONIC VIBRATION AND METHOD

This application claims priority under 35 USC §119(e) (1) of provisional application No. 60/081,111 filed Apr. 8, 1998.

TECHNICAL FIELD OF THE INVENTION

This invention relates generally to the field of semiconductor device fabrication and more particularly to a chemical mechanical polishing machine with ultrasonic vibration and method.

BACKGROUND OF THE INVENTION

Chemical mechanical polishing typically involves mounting a semiconductor wafer on a wafer holder. The wafer holder presses the wafer against an abrasive polishing surface which is moving with respect to the wafer. A chemical slurry is inserted between the wafer and the polishing surface. The chemical slurry includes abrasive particles which mechanically polish the wafer, as well as etchants which chemically remove material from the pad of the wafer. Typically, the wafer holder rotates the wafer as the wafer moves with respect to the polishing surface. This added motion increases the uniformity with which the wafer is polished. However, over time, the polishing surface may absorb the chemical slurry. This may change the properties of the abrasive surface over time.

SUMMARY OF THE INVENTION

Therefore, a need has arisen for an improved chemical mechanical polishing machine that addresses the disadvantages and deficiencies of the prior art.

A chemical mechanical polishing machine with ultrasonic vibration is disclosed. In one embodiment, the chemical mechanical polishing machine includes a movable abrasive surface. A wafer holder holds a wafer in contact with the abrasive surface, and a vibration generator vibrates the wafer during polishing. In another embodiment, the vibration generator vibrates the abrasive surface during polishing of the wafer.

A technical advantage of the present invention is that the ultrasonic vibration agitates the slurry, thereby preventing the abrasive particles suspended in the chemical slurry from settling into the abrasive surface. Another technical advantage is that the ultrasonic vibration provides an additional degree of motion between the wafer and the abrasive surface, thus increasing the uniformity with which the wafer is polished. Yet another technical advantage is that the ultrasonic vibration also increases the exchange of slurry underneath the wafer with fresh slurry surrounding the wafers.

BRIEF DESCRIPTION OF THE DRAWINGS

For a more complete understanding of the present invention and for further features and advantages thereof, reference is now made to the following description taken in conjunction with the accompanying drawings, in which.

DETAILED DESCRIPTION OF THE INVENTION

Figure 1A:
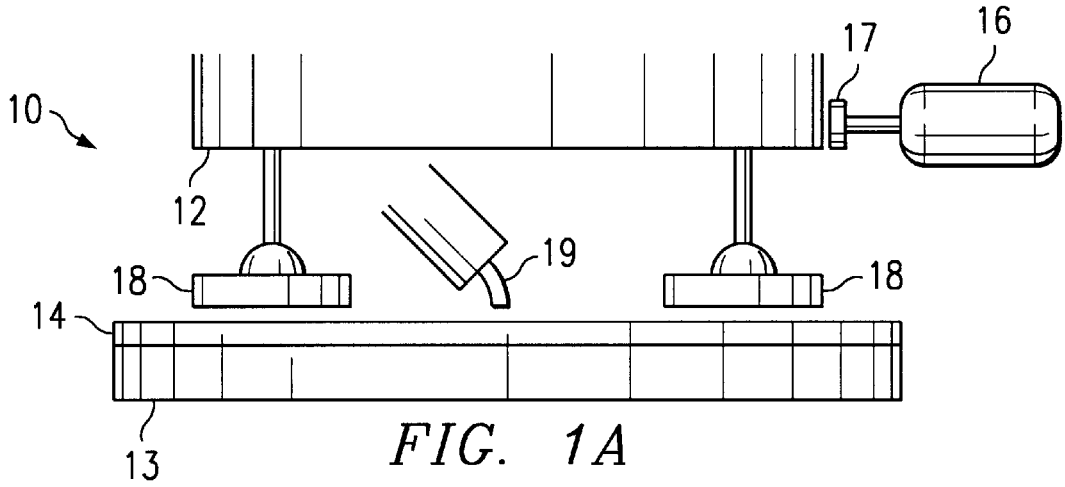
FIGS. 1A and 1B are side and top views, respectively, of a chemical mechanical polishing machine constructed in accordance with one embodiment of the present invention.
Figure 1B:
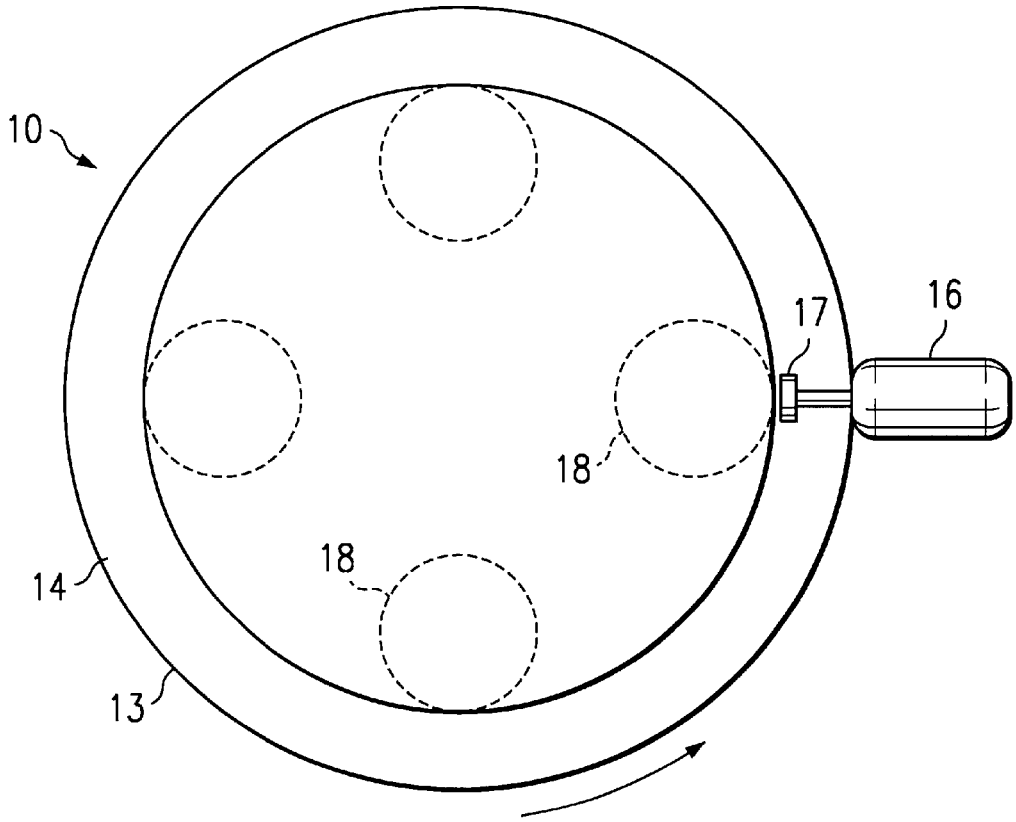

Referring to FIGS. 1A and 1B, a chemical mechanical polishing machine 10 constructed in accordance with one embodiment of the present invention is shown. Polishing machine 10 comprises a wafer holder 12, a plate 13 and a polishing pad 14 mounted on the plate 13. Wafer holder 12 holds a plurality of wafers 18 against polishing pad 14. Wafer holder 12 rotates each wafer 18 about its center axis. Wafer holder 12 may also be rotated about its own center by a motor (not shown). An ultrasonic vibration generator 16 maintains contact with wafer holder 12 by means of a contact plate 17. If wafer holder 12 is rotated during polishing, then contact between ultrasonic vibration generator 16 and wafer holder 12 may be maintained by means of a roller rather than contact plate 17.

Ultrasonic vibration generator 16 causes wafer holder 12 and wafers 18 to vibrate at ultrasonic frequencies with respect to polishing pad 14. A chemical slurry (not shown) is present between wafers 18 and polishing pad 14. The slurry is dispensed by a nozzle 19.

As a result of the ultrasonic vibration of wafers 18, the slurry is agitated and the abrasive particles suspended in the chemical slurry are prevented from settling into the polishing pad 14. In addition, the ultrasonic vibration of wafers 18 provides an additional degree of motion between wafers 18 and polishing pad 14. This increases the uniformity with which wafers 18 are polished. The ultrasonic collaboration also increases the exchange of slurry underneath wafers 18, which has been contaminated with material from the wafers, with fresh slurry surrounding the wafers. All of these beneficial effects have the further beneficial effect of accelerating the rate of removal of material from wafers 18, thus decreasing the polishing time.

Figure 2A:
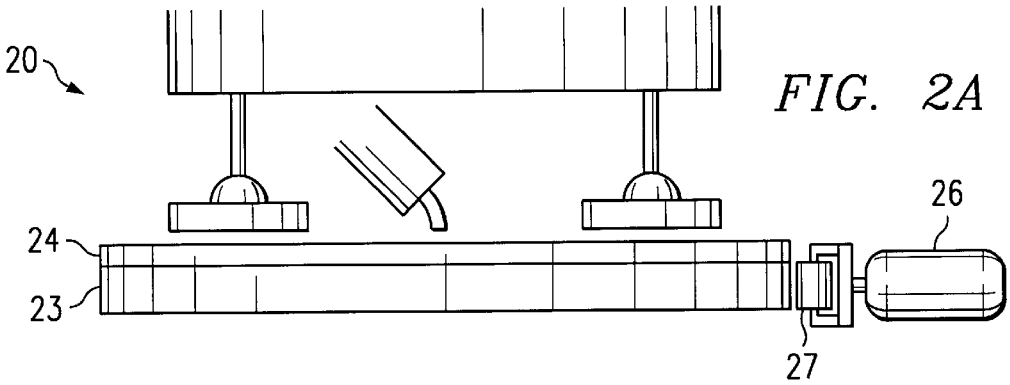
FIGS. 2A and 2B are side and top views, respectively, of a chemical mechanical polishing machine constructed in accordance with another embodiment of the present invention.
Figure 2B:
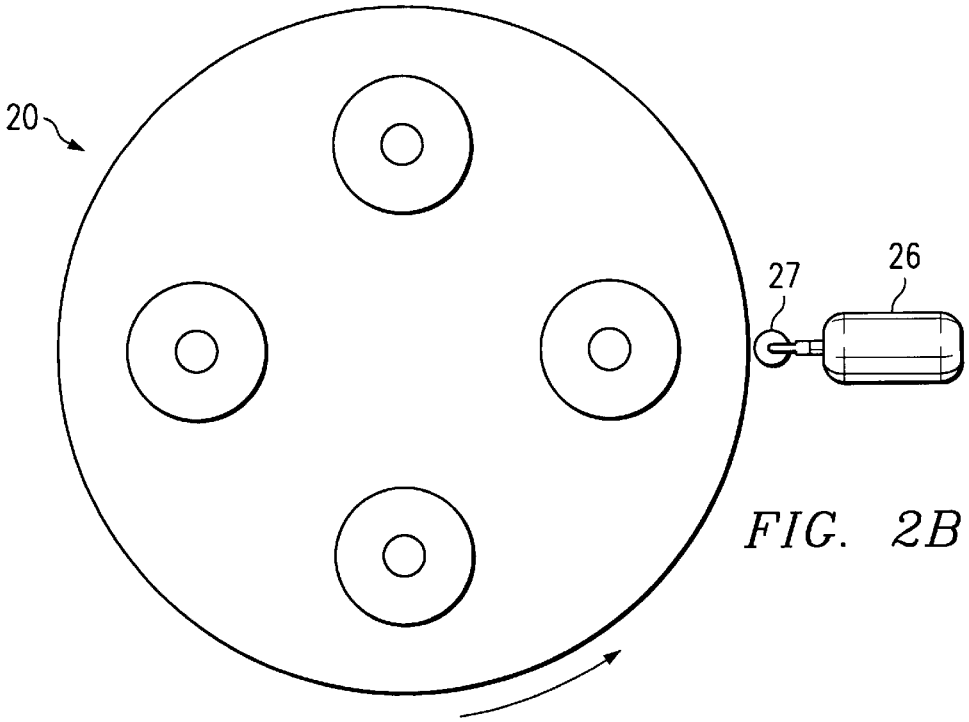

Referring to FIGS. 2A and 2B, a second chemical mechanical polishing machine 20 constructed in accordance with one embodiment of the present invention is shown. In this embodiment, ultrasonic vibration generator 26 maintains contact with the edge of plate 23 by means of a roller 27. Ultrasonic vibration generator 16 causes plate 23 and polishing pad 24 to vibrate as plate 23 rotates. As with chemical mechanical polishing machine 10, the ultrasonic vibration of plate 23 by ultrasonic vibration generator 16 prevents the abrasive particles suspended in the slurry from settling into polishing pad 24 and increases the uniformity with which wafers 28 are polished.

Figure 3:
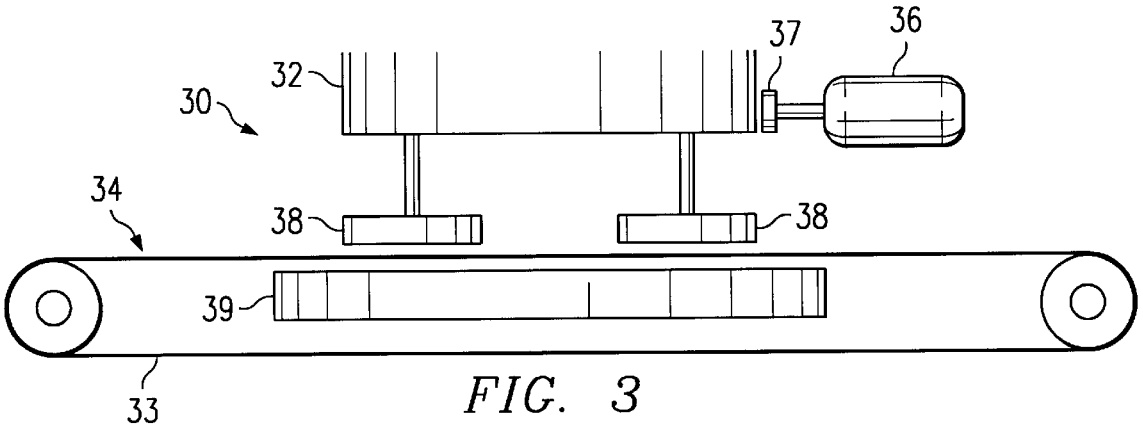
FIG. 3 is a side view of a chemical mechanical polishing machine constructed in accordance with yet another embodiment of the present invention.

Referring to FIG. 3, a third chemical mechanical polishing machine 30 constructed in accordance with one embodiment of the present invention is shown. Polishing machine 30 comprises a wafer holder 32, a belt 33 and an abrasive surface 34 on the belt 33. Wafer holder 32 holds a plurality of wafers 38 against belt 34, which is supported from underneath by a support plate 39.

Wafer holder 32 rotates each wafer 38 about its center axis as belt 33 slides across plate 39 underneath wafers 38. Wafer holder 32 may also be rotated about its own center by a motor (not shown).

An ultrasonic vibration generator 36 maintains contact with wafer holder 32 by means of a contact plate 37. If wafer holder 32 is rotated during polishing, then contact between ultrasonic vibration generator 36 and wafer holder 32 may be maintained by means of a roller rather than contact plate

37. Alternatively, ultrasonic vibration generator 36 may support plate 39, by way of a contact surface such as contact plate 37.

Ultrasonic vibration generator 36 causes wafer holder 32 and wafers 38 to vibrate at ultrasonic frequencies with respect to belt 33. A chemical slurry (not shown) is present between wafers 38 and belt 33. As with chemical mechanical polishing machine 10, the ultrasonic vibration of wafers 38 by ultrasonic vibration generator 36 prevents the abrasive particles suspended in the slurry from settling into belt 33 and increases the uniformity with which wafers 38 are polished.

While the invention has been particularly shown and described by the foregoing detailed description, it will be understood by those skilled in the art that various other changes in form and detail may be made without departing from the spirit and scope of the invention.

What is claimed is:

1. A chemical mechanical polishing machine comprising:

a set of rollers;

a continuously rotatable belt mounted on the rollers;

a movable abrasive surface attached to the belt;

a wafer holder operable to hold a wafer in contact with the abrasive surface;

a support plate operable to support the belt underneath the wafer holder; and a vibration generator operable to vibrate the abrasive surface during polishing of the wafer, comprising a contact surface in contact with the support plate, the contact surface being operable to transmit vibrations from the vibration generator to the plate during rotation of the belt.

2. The chemical mechanical polishing machine of claim 1, further comprising a slurry dispenser operable to dispense a slurry onto the abrasive surface.

* * * * *